US005664344A

United States Patent [19]

Marmonier

[11] Patent Number: 5,664,344

[45] Date of Patent: Sep. 9, 1997

[54] SHOE FOR THE PRACTICE OF A GLIDING SPORT

[75] Inventor: Gilles Marmonier, Saint Etienne de Crossey, France

[73] Assignee: Skis Rossignol S.A., Voiron, France

[21] Appl. No.: 667,814

[22] Filed: Jun. 21, 1996

[30] Foreign Application Priority Data

Jul. 13, 1995 [FR] France ..... 95 08775

[51] Int. Cl.[6] ..... A43B 5/04

[52] U.S. Cl. ..... 36/118.2; 36/117.3; 36/118.9

[58] Field of Search ..... 36/115, 89, 117.1, 36/117.3, 118.2, 118.8, 118.9, 119.1, 118.7; 280/14.2

[56] References Cited

U.S. PATENT DOCUMENTS

| | | | |
|---|---|---|---|
| 4,085,528 | 4/1978 | Delery | 36/118.8 X |
| 4,467,538 | 8/1984 | Olivieri | 36/117.1 |
| 4,944,100 | 7/1990 | Sartor et al. | 36/118.9 |
| 5,142,798 | 9/1992 | Kaufman et al. | 36/118.2 X |
| 5,435,080 | 7/1995 | Meiselman | 36/115 X |

FOREIGN PATENT DOCUMENTS

| | | | |
|---|---|---|---|
| 582551 | 2/1994 | European Pat. Off. | 36/118.2 |
| 2653310 | 4/1991 | France | 36/118.9 |
| 0646334 | 6/1995 | France . | |
| 2016120 | 10/1992 | WIPO | 36/118.8 |

*Primary Examiner*—B. Dayoan

*Attorney, Agent, or Firm*—Harris Beach & Wilcox, LLP

[57] ABSTRACT

A shoe for use in a gliding sport employing a board that includes a flexible boot having an upper section for securing the boot to a wearer's leg and a sole having a transverse recess level with arch of the wearer's foot. A block is arranged under the sole and is intended to interact with a binding on the board. A stirrup piece passes under the sole and has arms that rise to either side of the boot. A spoiler is mounted for articulation upon the stirrup piece. The rearward inclination of the spoiler is limited in assembly and wherein the lower face of the stirrup piece receives the block.

10 Claims, 4 Drawing Sheets

SHOE FOR THE PRACTICE OF A GLIDING SPORT

TECHNICAL FIELD

The invention relates to the field of shoes used in the practice of gliding sports, in particular those involving gliding on snow.

In the rest of the description we chose to describe the application of the invention to snowboarding while keeping in mind the fact that adaptation to a different gliding sport, such as cross-country skiing or alpine skiing, is obvious for the person skilled in the art.

PRIOR ART

As is known, there are several techniques for the practice of snowboarding. Mention may, in particular, be made of a first form termed "alpine gliding" which is practised on traditional downhill ski pistes, on prepared snow. A second form termed "freestyle" is also known, which takes place on particular runs forming semicylindrical valleys, generally artificially hollowed, and commonly referred to by the expression "halfpipe". Finally, it is also known that snowboarding is practised on powdery snow slopes.

It is quite clear that each of these modes of use requires a number of properties in the articulation between the user's leg and the board, in particular as regards forward flexing and rearward support.

Chronologically, three different types of shoe have been proposed, to be combined with corresponding bindings which are also different.

Firstly, the first shoes used for the practice of snowboarding were downhill ski boots, that is to say boots having a rigid shell allowing limited forward inclination of the leg. These shoes are fitted to bindings having two elements, namely a fixed stirrup piece into which the heel of the shoe is inserted, and an articulated front stop in the form of a stirrup, capable of engaging the front portion of the toe of the shoe. Quite clearly, this type of shoe proves to be too rigid, in particular in disciplines requiring large angulations of the tibia relative to the foot, such as the technique practised in halfpipes. This type of shoe also proves to be poorly suited for walking.

Subsequently, the use of flexible shoes was proposed, these most generally having the form of a boot which is advantageously practical for walking. Unfortunately, the existence of this flexibility made it necessary to develop the bindings in order to allow them to cater for rearward support. A number of bindings were thus developed having a platform on which the shoe is fixed by several straps and which has a rigid rear plate fixed substantially perpendicularly to the board and rising toward the calf. Unfortunately, although satisfactory, this type of binding constitutes a molded part which is particularly complex to produce, bulky and difficult to transport. It furthermore does not permit automatic fitting and removal of the shoe.

Finally, a third type of binding is known, combining a platform which is fixed on the board and which interacts with complementary arrangements, advantageously retractable, secured to the shoe. This type of shoe is relatively rigid, and is either similar to a traditional ski boot or has a sole made of hard material and a rigid back upper for allowing rearward support. It is thus seen that the use of this advantageous type of binding requires the use of a rigid shoe which therefore has drawbacks for walking and does not make it possible to obtain optimum performance during the practice of snowboarding.

BRIEF DESCRIPTION OF THE INVENTION

The problem which the invention proposes to solve is to combine the use of a flexible boot, giving qualities of comfort to the user, with a rigid frame allowing rearward support.

Thus, the invention relates to a shoe for the practice of a gliding sport using a board, of the type consisting of a flexible boot, including:

- an upper enclosing the user's lower leg and foot,
- a sole having a transverse recess level with the arch of the foot,
- and a block, arranged under the sole and intended to interact with complementary means on the binding secured to the top of the board.

This shoe is one which includes:

- a monobloc rigid stirrup piece passing under the sole in the median part of the latter and rising on each side of the upper along a rearwardly inclined direction and enclosing the rear of the upper level with the calcineus,
- and a spoiler enclosing the back of the leg of the user, the bottom of this spoiler being articulated to the monobloc rigid stirrup piece level with the malleoli, the inclination of the spoiler being limited toward the rear, and wherein the lower face of that portion of the rigid stirrup piece located under the sole receives the block for interacting with the binding.

Put another way, the shoe combines a flexible boot structure, to promote feelings of comfort for the user, with a rigid frame that is articulated only toward the front.

The invention consists in using a frame in two parts, the bottom part of which includes the block for engaging with the binding. By virtue of its location, the stirrup piece is thus firmly secured to the shoe while providing engagement on the board. In this way, the feelings and the forces are transmitted directly, which improves the control performance of the gliding board.

In other words, in contrast to all the other existing shoe types, the invention combines a flexible structure, thus making it easy to walk, with a rigid structure, allowing rearward support and engagement with the binding.

In an advantageous embodiment, the block and the rigid stirrup piece form a monobloc assembly directly produced by molding. In this way, the invention provides a simple solution to the problem of efficient engagement of the block on the shoe.

Indeed, with all known shoe types, the blocks are generally attached under the sole, which requires particular arrangements such as riveting or screwing.

In an advantageous form, the rigid stirrup piece passes through the recess for the arch of the foot.

In an embodiment which makes it possible to solve the problem of efficient anchoring of the articulation of the spoiler, the boot has a bottom portion surrounding the sole and rising laterally to the level of the malleoli, the articulation of the spoiler and of the rigid stirrup piece being secured to this bottom portion of the boot. Put another way, the bottom part of the upper surrounds the foot and is made of a semi-rigid material on which the stirrup piece is fixed as far as its upper end. The articulation carried by the top of the stirrup piece thus bears and is anchored in this semi-rigid portion of the boot, which ensures efficient holding. The articulation of the spoiler is thereby improved.

In another embodiment, the stirrup-piece/spoiler assembly has means allowing it to be temporarily decoupled from the boot. In other words, when the user no longer has need of the articulated rigid structure, he has the possibility of detaching it from the upper in order to be left with a simple flexible boot which is particularly well suited for walking. The problem of combining a shoe which is comfortable for walking and a shoe which has rigid technical arrangements is thus advantageously solved.

In a practical embodiment, the stirrup piece has a slot level with the Achilles tendon, intended to make it possible to move apart the arms of the stirrup piece and to decouple it from the boot. Put another way, the stirrup piece constitutes an attached piece which is easy to extract by simply moving apart and sliding its two lateral parts.

With the aim of improving the transfer of forces between the leg and the snowboard, the spoiler and the stirrup piece include straps intended to grip the lower leg at the top of the upper. In this way, the leg is firmly secured to the spoiler, and consequently the stirrup piece, and thus the binding.

In a more sophisticated embodiment, the means intended to limit the inclination of the spoiler toward the rear are disengageable. In this way, it is possible for the spoiler to tilt rearward through a large amplitude, and the rearward rigidity of the frame can be obviated for walking phases.

BRIEF DESCRIPTION OF THE DRAWINGS

The way in which the invention is embodied in its application to snowboarding, as well as the advantages which result therefrom will emerge clearly from the following description, supported by the appended figures.

DETAILED DESCRIPTION OF THE INVENTION

Figure 1:
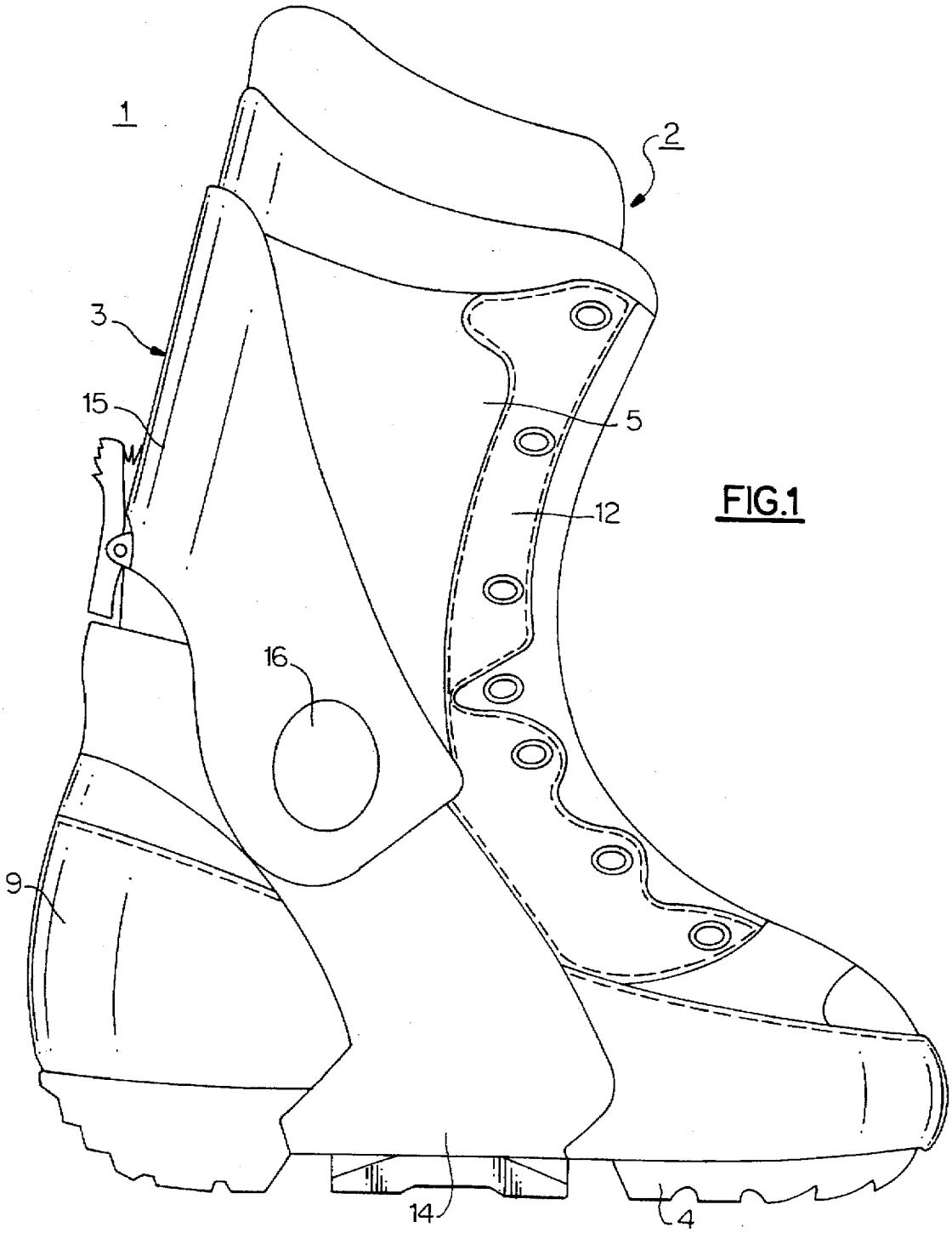
FIG. 1 is a side view of a shoe according to the invention, the rigid frame being secured to the boot.
Figure 2:
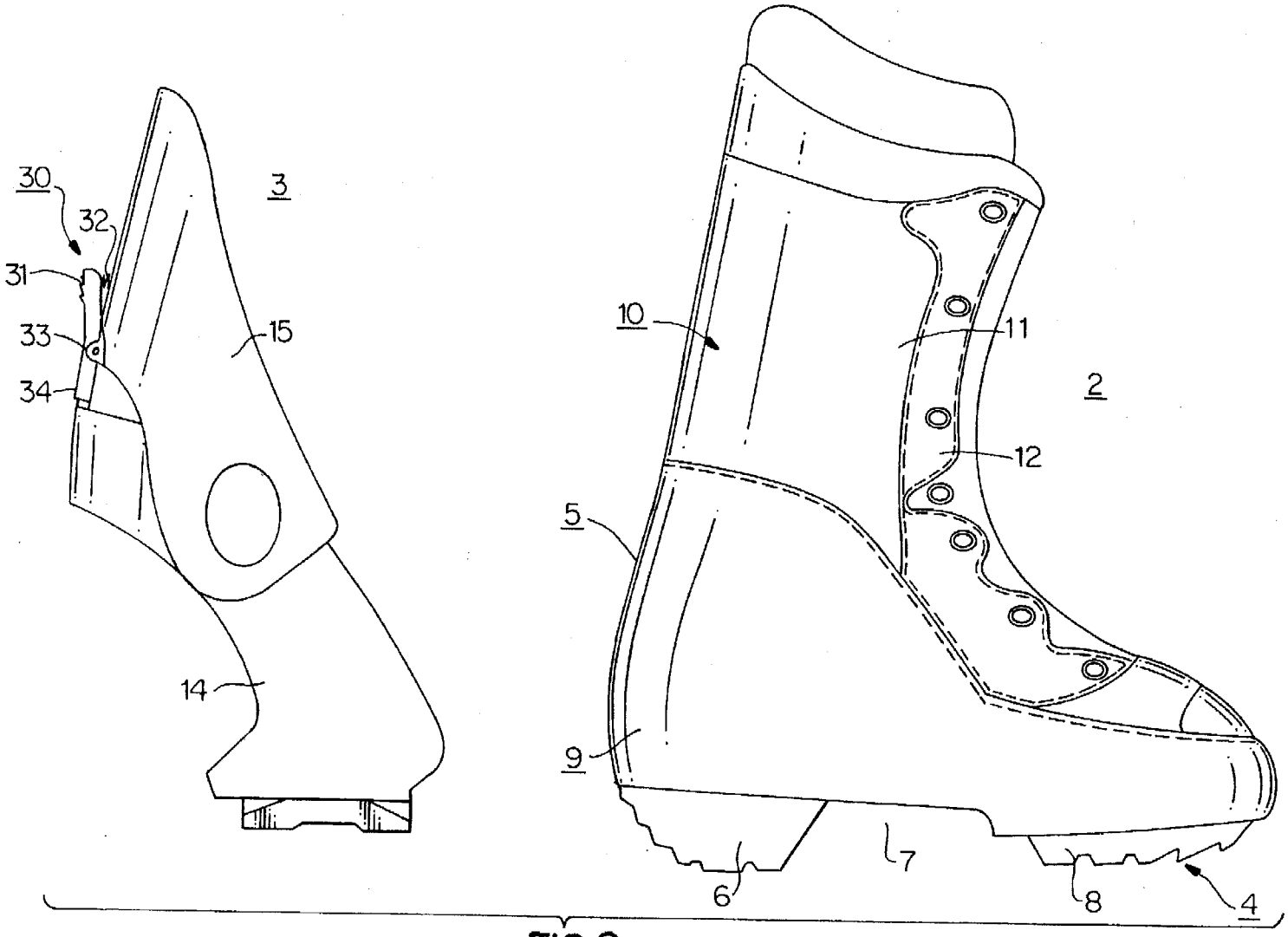
FIG. 2 is a side view of the shoe according to the invention, in which the rigid frame has been detached.

The snowboarding shoe (1) according to the invention, shown in FIG. 1, comprises two separate sub-assemblies, namely a boot (2) and a rigid frame (3).

In the conventional way, the boot (2) is composed of a sole (4) onto which an upper (5) is attached. The sole is subdivided into three juxtaposed regions, namely a heel (6), a transverse recess (7) corresponding to the arch of the foot, and a front part (8) formed from a support region. The lower surfaces of the heel (6) and of the front support region (8) are advantageously located in the same horizontal plane. The top borders of this sole (4) are connected to the upper (5). The upper (5) of this boot comprises a bottom part (9) which surrounds the heel up to the level of the calcineus as well as the malleoli and is extended forward by a portion, of short height, which forms borders rising substantially to halfway up the toes of the feet. This bottom part of the upper consists of a semi-rigid plastic material or a synthetic leather which is slightly deformable but is sufficiently rigid to receive the rigid frame (3).

A top portion (10) consisting of the two lateral flanks (11), enclosing the rear part of the leg, a lacing region (12) located toward the front, level with the tibia, as well as the top front end of the upper, forming protection for the toes, is stitched onto this bottom part (9) of the upper (5).

The design of this upper is conventional in the field of snowboarding shoes, and so it need not be described in detail here.

The essence of the invention besides in the addition of a rigid articulated structure (3) to this boot (2).

In the form of the invention which is illustrated, this rigid frame is subdivided into two separate sub-assemblies, namely a stirrup piece and a spoiler (15). The stirrup piece (14) has some degree of symmetry in a longitudinal vertical plane of the shoe. It is in contact with the sole at the recess (7) corresponding to the arch of the foot. This lower portion (21) is extended on each side of the shoe by two arms (20) which are curved back toward the calcineus while passing over the malleoli.

In this embodiment, the stirrup piece is connected to the bottom part of the boot (9), for example by stitching.

In a first embodiment (14), the two arms are connected level with the calcineus. In this way, the stirrup piece encloses the rear part of the shoe, level with the heel, and is therefore firmly connected to the shoe.

Figure 4:
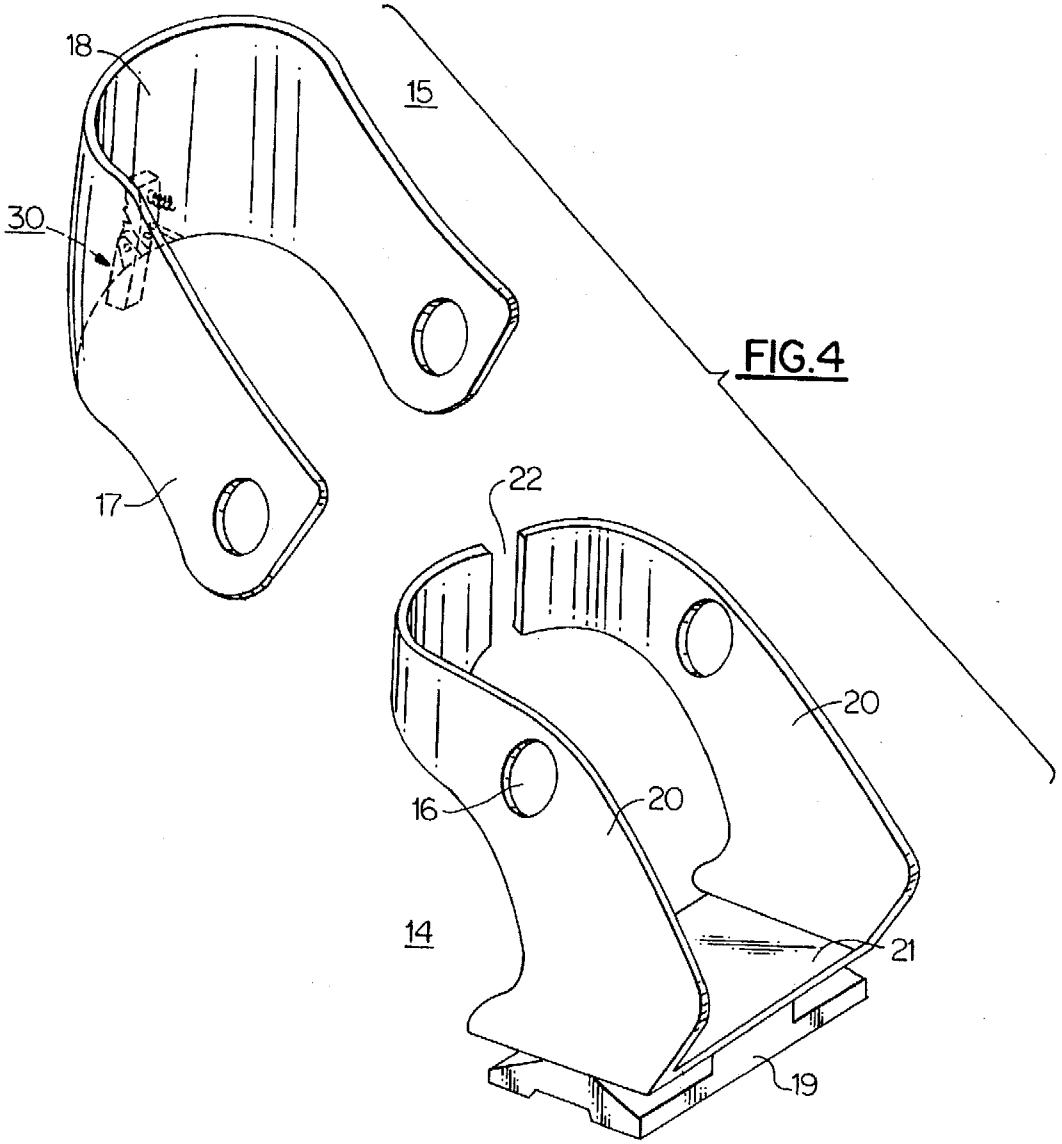
FIG. 4 is an outline perspective view of the frame according to the invention, in its removable version.

In another embodiment, illustrated in FIG. 4, the two arms (20) of the stirrup piece (14) are independent level with the Achilles tendon, which makes it possible to detach the rigid frame (3) from the shoe at will. In practice, the two arms (20) are separated by a straight vertical slot (22). In an advantageous arrangement, the slot will be locked by a fastener of the "hooked velvet" type, known by the registered trademark VELCRO, or any similar attachment means. This arrangement is particularly advantageous when it is desired to use the snowboarding shoe as a walking boot.

The frame is advantageously clipped then fixed onto the boot. To this end, the stirrup piece and the spoiler have straps for securing the frame and the boot.

As already stated, the lower part (21) of the stirrup piece (14), which lies in the recess corresponding to the arch of the foot, receives a block (19) intended to interact with the binding. In known fashion, this block (19) may assume any forms allowing efficient engagement with the binding, namely a partially frustoconical or trapezoidal form, or alternatively a groove form having a transverse or longitudinal pin, or else a localized rib having a pin which extends beyond the said rib.

Of course, the invention encompasses other alternative arrangements of the stirrup piece. Mention could, in particular, be made of an arrangement (not illustrated) in which the stirrup piece passes not through the recess for the arch of the foot but directly under the heel (6).

Level with the malleoli, this stirrup piece (14) has two articulation pins (16) pointing toward the outside of the shoe.

The second part of the rigid frame consists of a spoiler (15), the lateral portions (17) of which are articulated to said pin (16) provided for this purpose on the stirrup piece. These two lateral portions (17) are connected to a posterior region (18) which bears on the back of the upper (5) from the height of the calcineus to the top region of the boot.

One of the objects of the invention is to permit rearward support. To this end, the assembly consisting of the spoiler and the stirrup piece has means making it possible to limit its rearward inclination.

In the embodiment illustrated in the figures, level with the bottom portion of its rear ridge, the spoiler has an articulated lever (30), the bottom part (34) of which lies in front of the top part of the stirrup piece (14) when the lever is relaxed.

This lever (30) is advantageously equipped with a spring (32) arranged between the top part (31) of the lever (30) and the rear of the spoiler (15). In the relaxed position, the spring (32) pushes back the top part (31) of the lever (30) so that the bottom part (34) of the lever (30) is in contact with the stirrup piece (14) and prevents the spoiler from articulating rearward. In contrast, when the user presses on the top part (31) of the lever (30), the spring compresses and the lever pivots about the pin (33) located in the bottom part of the spoiler (15). At this moment, the bottom part (34) of the lever (30) lifts away from the stirrup piece (14) and therefore allows the spoiler (15) to tilt rearward.

Figure 3:
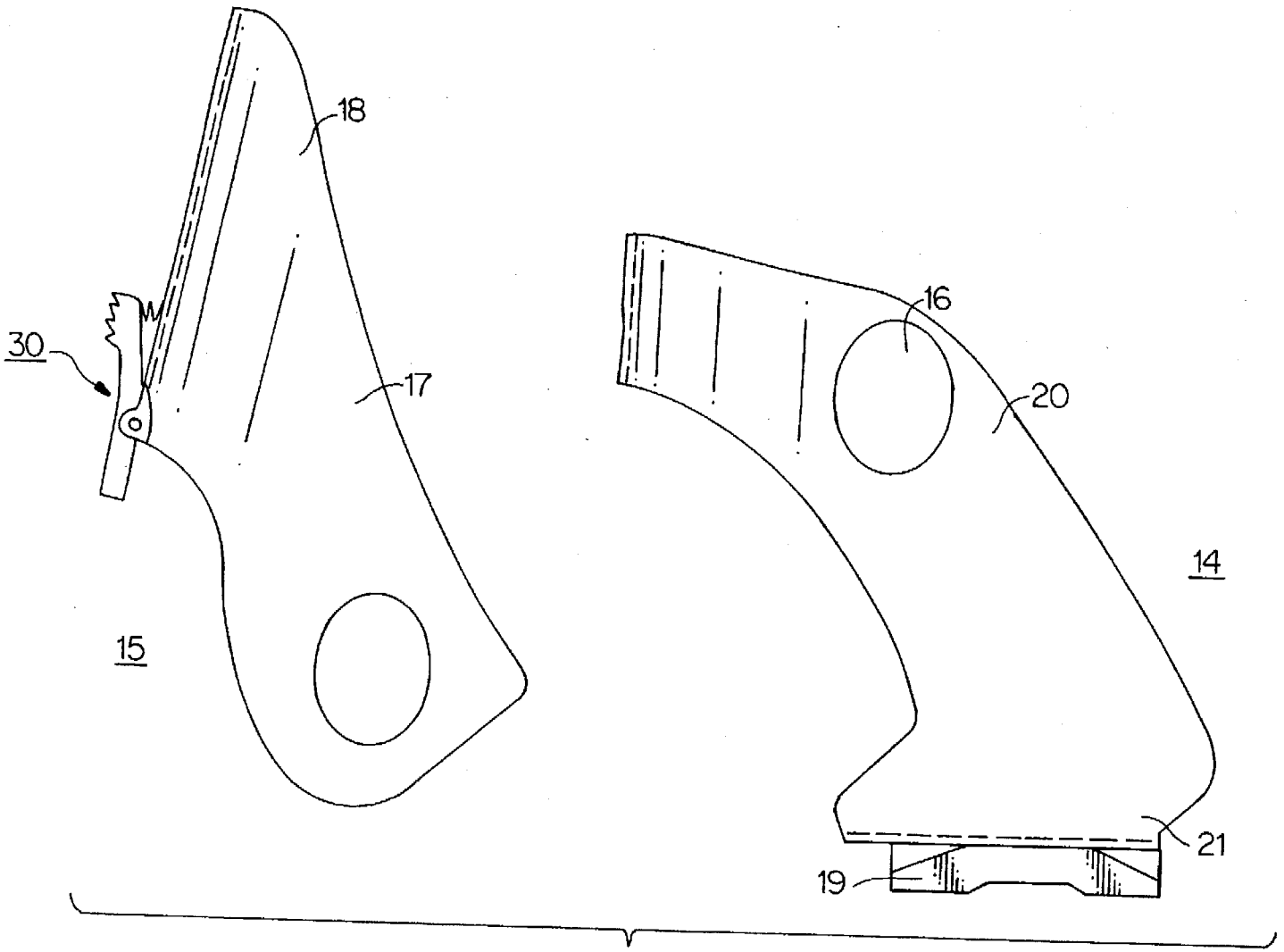
FIG. 3 is a side view of the rigid frame in which the collar is removable.

In the variants illustrated in FIGS. 3 and 4, the spoiler (15) can be removed from the stirrup piece (14) by moving apart its lateral portions. Engaging and positional holding are effected in a manner known to the person skilled in the art.

For the sake of clarity of the drawings, they do not represent the various straps which may connect the lateral parts of the spoiler level with the lower leg or join the arms (20) of the stirrup piece level with the instep.

As is seen, the snowboarding shoe according to the invention has many advantages.

On the one hand, it combines a rigid frame with a flexible boot. This shoe thereby fulfils both technical functions, permitting the sporting practice of snowboarding, as well as a comfort function which is particularly appreciated when walking.

On the other hand, the boot, and above all its lower extension by the block for engaging with the binding, permits efficient transfer of support and forces between the shoe and the snowboard.

Of course, this description and the advantages which emerge therefrom can be adapted easily to alpine skis or to cross-country skis, and more generally to all gliding sports which use a board.

I claim:

1. Footwear for use in a gliding sport involving a board, said footwear consisting of: a flexible boot, said boot having an upper section whereby the boot is capable of being enclosed about the calcaneus, malleoli and Achilles tendon regions of a wearer's leg and foot, a sole having a transverse recess in the median part thereof, and a block positioned under the sole for interacting with a binding, a rigid stirrup piece passing under the sole in the median part thereof having a lower face located under the sole for receiving said block, and arms rising on either side of the upper section, said arms being inclined toward the rear of the boot to enclose the rear of the boot whereby the arms encircle the calcaneus region, and a spoiler encircling the back of the boot that is mounted upon the stirrup piece by an articulation means whereby said articulation means is about level with the malleoli and means for limiting rearward inclination of said spoiler.

2. The shoe as claimed in claim 1, wherein the block (19) and the rigid stirrup piece (14) form a monobloc assembly directly produced by molding.

3. The shoe as claimed in claim 1, wherein the rigid stirrup piece (14) passes through the recess (7) for the arch of the foot.

4. The shoe as claimed in claim 1, wherein the boot (2) has a bottom portion (9) surrounding the sole (4) and rising laterally to the level of the malleoli, the articulation (16) of the spoiler (15) and of the rigid stirrup piece (14) being located level with the malleoli.

5. The shoe as claimed in claim 1, wherein the stirrup-piece/spoiler assembly (14, 15) has means capable of allowing it to be temporarily decoupled from the boot.

6. The shoe as claimed in claim 5, wherein the stirrup piece has a slot (22) level with the Achilles tendon, intended to make it possible to move apart the arms (20) of the stirrup piece (14) and to decouple it from the boot (2).

7. The shoe as claimed in claim 1, wherein one of the spoiler (15) has means capable of allowing it to be temporaily decoupled from the stirrup piece (14).

8. The shoe as claimed in claim 1, wherein the spoiler and the stirrup piece includes straps intended to grip the lower leg at the top of the upper section.

9. The shoe as claimed in claim 1, wherein the means intended to limit the inclination of the spoiler toward the rear are disengageable.

10. A shoe (1) for the practice of a gliding sport using a board, said shoe being of the type consisting of a flexible boot (2), and boot including:

an upper (5) enclosing the user's lower leg and foot, a sole (4) having a transverse recess (7) level with the arch of the foot, and a block (19), arranged under the sole and intended to interact with complementary means on the binding secured to the top of the board, which boot further includes:

a monobloc rigid stirrup piece (14) passing under the sole (4) in the median part of the latter and rising on each side of the upper (5) along a rearwardly inclined direction and enclosing the rear of the upper level with the calcaneus, and a spoiler (15) enclosing the back of the leg of the user, the bottom (17) of this spoiler being articulated to the monobloc rigid stirrup piece (14) level with the malleoli, the inclination of the spoiler being limited toward the rear, and wherein the lower face (21) of that portion of the rigid stirrup piece (14) located under the sole (4) receives the block (19) for interacting with the binding.

* * * * *